US008375755B2

(12) United States Patent
Goto et al.

(10) Patent No.: US 8,375,755 B2
(45) Date of Patent: Feb. 19, 2013

(54) METAL WORKING FLUID COMPOSITION AND METAL WORKING METHOD

(75) Inventors: Koichi Goto, Fujisawa (JP); Yuji Aizawa, Fujisawa (JP); Satoshi Mima, Fujisawa (JP)

(73) Assignee: Kyodo Yushi Co., Ltd., Fujisawa (JP)

( * ) Notice: Subject to any disclaimer, the term of this patent is extended or adjusted under 35 U.S.C. 154(b) by 579 days.

(21) Appl. No.: 12/525,145

(22) PCT Filed: Feb. 1, 2008

(86) PCT No.: PCT/JP2008/051670

§ 371 (c)(1),
(2), (4) Date: Jul. 30, 2009

(87) PCT Pub. No.: WO2008/093844

PCT Pub. Date: Jul. 8, 2008

(65) Prior Publication Data

US 2010/0077817 A1 Apr. 1, 2010

(30) Foreign Application Priority Data

Feb. 1, 2007 (JP) ..... 2007-022883

(51) Int. Cl.
*B21B 45/02* (2006.01)

(52) U.S. Cl. ..... 72/42

(58) Field of Classification Search ..... 72/41, 42; 510/245, 254, 261, 264, 265, 500; 508/250, 508/271

See application file for complete search history.

(56) References Cited

U.S. PATENT DOCUMENTS

| | | | | |
|---|---|---|---|---|
| 3,929,563 | A | 12/1975 | Shema et al. | |
| 4,105,431 | A | 8/1978 | Lewis et al. | |
| 4,295,887 | A | 10/1981 | Buckley et al. | |
| 5,142,058 | A | 8/1992 | Willingham et al. | |
| 5,166,390 | A * | 11/1992 | Weinstein et al. | 558/254 |
| 5,489,588 | A * | 2/1996 | Hsu | 514/237.8 |
| 6,034,081 | A | 3/2000 | Whittemore et al. | |
| 6,902,727 | B2 * | 6/2005 | Xianbin et al. | 424/78.08 |
| 2003/0168626 | A1 | 9/2003 | Eastwood et al. | |
| 2009/0136551 | A1 * | 5/2009 | Hofmann et al. | 424/411 |
| 2009/0203756 | A1 | 8/2009 | Falk et al. | |
| 2010/0075984 | A1 * | 3/2010 | Hidalgo et al. | 514/254.04 |
| 2010/0093736 | A1 * | 4/2010 | Coburn et al. | 514/241 |

FOREIGN PATENT DOCUMENTS

| | | |
|---|---|---|
| JP | 46-4199 | 2/1971 |
| JP | 5-59360 | 3/1993 |
| JP | 6-31388 | 4/1994 |
| JP | 6-76590 | 9/1994 |
| JP | 7-30348 | 4/1995 |
| JP | 7-37632 | 4/1995 |
| JP | 2510233 | 4/1996 |
| JP | 2645675 | 5/1997 |
| JP | 2676056 | 7/1997 |
| JP | 9-316482 | 12/1997 |
| JP | 10-298012 | 11/1998 |
| JP | 11-506103 | 6/1999 |
| JP | 2003-535188 | 11/2003 |
| JP | 2004-238338 | 8/2004 |
| WO | WO 2007/033764 | 3/2007 |

OTHER PUBLICATIONS

International Search Report for PCT/JP2008/051670, mailed Apr. 8, 2008.

Written Opinion of the International Searching Authority for PCT/JP2008/051670, mailed Apr. 8, 2008.

Willingham, Gary L. et al, "Compatibility and Stabilization of Methylchloro/Methyl-Isothiazolone in Metalworking Fluids", Journal of the Society of Tribologists and Lubrication Engineers, vol. 47, No. 9, (1991), pp. 729-732.

Bennett, E.O. et al., "Corrosion Inhibitors as Preservatives for Metal Working Fluids—2. Morpholine Compounds", Materials Performance, vol. 18, No. 6, (1979), pp. 40-45.

Extended European Search Report dated Apr. 21, 2011, issued in corresponding European Application No. 08704372.5-2104.

Database WPI Week 200459, Thomson Scientific, London GB, AN 2004-608285 XP002630233 & JP 2004-238338 A (Permachem Asia LTD) Aug. 2004, Abstract 2 pages.

Michael and Irene Ash, "Handbook of Preservatives", Synapse Information Resources Inc., 2004, pp. 76, 304 and 838.

Clariant, "Nipacide MBM Technical Data", Sep. 2001, pp. 1-4, URL:http://www.clariant.com/C125691A003596E5/lookupDownloads/MBM+TDS.pdf/$FILE/MBM+TDS.pdf (retrieved Apr. 28, 2011).

Korean Office Action dated Apr. 20, 2011, issued in corresponding Korean Application No. 10-2009-7016678 with English Translation.

* cited by examiner

*Primary Examiner* — Dana Ross
*Assistant Examiner* — Homer Boyer
(74) *Attorney, Agent, or Firm* — Nixon & Vanderhye P.C.

(57) ABSTRACT

The invention provides a metal working fluid composition which comprises a morpholine compound and an isothiazoline compound and a metal working method which makes use of the metal working fluid composition. The composition is excellent in antiseptic properties, and can widely be applied to metal working techniques such as cutting, grinding, form rolling, press working and plastic working techniques.

7 Claims, No Drawings

METAL WORKING FLUID COMPOSITION AND METAL WORKING METHOD

This application is the U.S. national phase of International Application No. PCT/JP2008/051670, filed 1 Feb. 2008, which designated the U.S. and claims priority to Japan Application No. 2007-022883, filed 1 Feb. 2007, the entire contents of each of which are hereby incorporated by reference.

TECHNICAL FIELD

The present invention relates to a metal working fluid composition, which can widely be used in the metal working techniques such as the cutting, grinding, form rolling, press working and plastic working techniques and a metal working method, which makes use of the foregoing metal working fluid composition and the present invention, more particularly, relates to a water-soluble metal working fluid composition, which is used after it is diluted with water, in particular, a water-soluble metal working fluid composition, which is excellent in the antiseptic properties, as well as a metal working method, which makes use of the foregoing metal working fluid composition.

BACKGROUND ART

In general, there has been used a cutting/grinding fluid composition in the cutting/grinding processes. As the most important function of the cutting/grinding fluid composition, there can be listed, for instance, the lubricating action and the cooling action and these actions would permit the improvement of productivity such as the elongation of the service life of tools used in the metal working and the improvement of the precision of the finished plane of a subject to be processed and the improvement of the production efficiency.

It has been known, for a long time, that there are two types of metal working fluid compositions and more specifically, the non-water-soluble type one, on the one hand, which is used in the form of a stock solution and the water-soluble type one, on the other hand, which is used after it is diluted with water. In this respect, the use of the water-soluble type one has recently become the leading mainstream in this art while taking into consideration the saving of natural resources, the protection of the environment (working environment and the environment of the earth) and any risk of causing a fire.

The use of a water-soluble type metal working fluid composition would result in the reduction of the risk of causing a fire. On the contrary, in case of the water-soluble type metal working fluid composition, the organic components present therein should be diluted with water upon its practical use, and therefore, various problems arise such that microorganisms are easily proliferated in the diluted fluid composition, that the latter gives out bad smells due to the putrefaction thereof and that the quality thereof is accordingly impaired. For this reason, the diluted metal working fluid composition should frequently be replaced with fresh one within a short period of time and this in turn becomes a cause of the wasteful use of the natural resources and the pollution of the environment of the earth.

As means for solving the foregoing problems, there have been known, for instance, a water-soluble metal working fluid composition which makes use of peppermint oil (see Patent Document 1 specified below); a water-soluble metal working fluid composition which makes use of cinnamon oil (see Patent Document 2 specified below); a water-soluble metal working fluid composition which makes use of an aromatic amine or an alicyclic amine (see Patent Document 3 specified below); a water-soluble fluid composition for the grinding process, which makes use of a benzolic compound and a para-oxy-benzoic acid ester compound (see Patent Document 4 specified below); an antibacterial water-soluble fluid composition for the cutting process, which makes use of alkylene diamine (see Patent Document 5 specified below); a water-soluble fluid composition for the cutting process, which makes use of a fatty acid alkanolamide-ethylene oxide adduct and an alkylamine-ethylene oxide adduct, an alicyclic amine-ethylene oxide adduct or a fatty acid-higher alcohol adduct (see Patent Document 6 specified below); a water-soluble fluid composition for the cutting/grinding processes which makes use of a primary, secondary or tertiary alkylamine, aromatic diamine-oxyalkylene adduct, or an alicyclic diamine-oxyalkylene adduct (see Patent Document 7 specified below); a fluid composition comprising a primary alkanolamine, a carboxylic acid having 6 to 24 carbon atoms, and a specific alkylene-diamine (see Patent Document 8 specified below); and a microorganism-killing composition comprising, in combination, an N-substituted benzo-isothiazoline type compound (such as N-butylbenzoisothiazolin-3-one) and non-N-substituted benzo-isothiazoline type compound having a microorganism-killing action (such as bactericidal, fungicidal or algicidal actions) (see Patent Document 9 specified below).

However, any sufficient effect of preventing putrefaction of the fluid composition cannot be ensured through the use of these water-soluble metal working fluid compositions, or the metal working fluid compositions each showing such an effect make use of, for instance, a halogen atom-containing compound, a polycyclic aromatic compound, a phenolic compound or a metal salt. Some of them are compounds whose use is restricted by PRTR and the use thereof would be apprehensive of adversely affecting the human bodies.

Patent Document 1: JP No. 2,676,056;
Patent Document 2: JP No. 2,645,675;
Patent Document 3: JP No. 2,510,233;
Patent Document 4: JP-B-H07-037632;
Patent Document 5: JP-B-H07-030348;
Patent Document 6: JP-B-H06-031388;
Patent Document 7: JP-A-H09-316482;
Patent Document 8: JP-B-H06-076590;
Patent Document 9: JP-A-H10-298012.

DISCLOSURE OF THE INVENTION

Problems that the Invention is to Solve

It is an object of the present invention to provide a metal working fluid composition, which can widely be applied to the metal working techniques such as cutting, grinding, form rolling, press working and plastic working techniques. In particular, it is an object of the present invention to provide a water-soluble metal working fluid composition, which is excellent in the ability of preventing putrefaction, and a metal working method which makes use of the foregoing metal working fluid composition.

Means for the Solution of the Problems

The inventors of this invention have conducted various studies to eliminate the foregoing problems, have found that the use of specific antiseptic agents in combination permits the achievement of a considerably excellent antiseptic effect as compared with that accomplished by the use of a water-soluble metal working fluid composition which comprises a conventional antiseptic agent and have thus completed the present invention. According to the present invention, there are thus provided, as will be detailed below, a water-soluble metal working fluid composition and a metal working method which makes use of the metal working fluid composition.

1. A metal working fluid composition which comprises a morpholine compound and an isothiazoline compound.
2. The metal working fluid composition as set forth in the foregoing item 1, which further comprises a surfactant.
3. The metal working fluid composition as set forth in the foregoing item 1 or 2, wherein the morpholine compound is N,N-methylene-bis-morpholine.
4. The metal working fluid composition as set forth in any one of the foregoing items 1 to 3, wherein the isothiazoline compound is N-n-butyl-1,2-benzo-isothiazolin-3-one.
5. The metal working fluid composition as set forth in any one of the foregoing items 2 to 4, wherein the surfactant is at least one member selected from the group consisting of nonionic surfactants, anionic surfactants, cationic surfactants, and amphoteric surfactants.
6. The metal working fluid composition as set forth in any one of the foregoing items 1 to 5, wherein the fluid composition comprises 0.01 to 10.0% by mass of the morpholine compound, and 0.001 to 5.0% by mass of the isothiazoline compound.
7. The metal working fluid composition as set forth in any one of the foregoing items 2 to 6, wherein the fluid composition comprises 0.05 to 80% by mass of the surfactant.
8. A metal working method characterized in that a metal working fluid composition as set forth in any one of the foregoing items 1 to 7 is diluted with water to give a liquid having a concentration ranging from 1 to 30% by mass, prior to the practical use thereof.
9. The metal working method as set forth in the foregoing item 8, wherein the metal working is cutting process or grinding process.

Effects of the Invention

The metal working fluid composition according to the present invention permits the efficient practice of cutting, grinding, form rolling, press working and plastic working of metallic materials. In addition, the fluid composition of the present invention is excellent in the antiseptic properties and it is seldom that the fluid composition adversely affects the environment of the earth and the human bodies. The fluid composition of the present invention comprises a morpholine compound and a thiazoline compound and further an optional surfactant in combination and therefore, the fluid composition is significantly improved in the antiseptic properties and the service life of the metal working fluid composition can thus significantly be extended, as compared with conventionally known metal working fluid compositions. As a result, the fluid composition of the present invention would permit the saving of natural resources, and the reduction of the amount of waste matter (waste fluid) and accordingly, the use thereof would result in the reduction of any adverse effect on the environment of the earth.

EMBODIMENTS FOR CARRYING OUT THE INVENTION

Examples of morpholine compounds (component A) preferably used in the fluid composition of the present invention include morpholine, N,N-methylene-bis-morpholine, N-(2-aminoethyl) morpholine, N-(3-amino-propyl) morpholine, 4-trityl morpholine, and 4-phenyl morpholine. Particularly preferably used herein is N,N-methylene-bis-morpholine.

Examples of isothiazoline compounds (component B) preferably used in the fluid composition of the present invention include N-methylbenzo-iso-thiazolin-3-one, N-ethyl-benzo-isothiazolin-3-one, N-propylbenzo-iso-thiazolin-3-one, N-n-butyl-benzoisothiazolin-3-one, N-isobutyl-benzo-iso-thiazolin-3-one, N-pentyl-benzoisothiazolin-3-one, N-isopentyl-benzo-iso-thiazolin-3-one, N-hexyl-benzoisothiazolin-3-one, N-allyl-benzo-isothiazolin-3-one, and N-(2-butenyl)-benzoisothiazolin-3-one. Among them, preferably used herein is N-n-butyl-benzoisothiazolin-3-one.

It is preferred to incorporate a surfactant (component C) to the fluid composition of the present invention. Usable herein as such a surfactant may be a nonionic surfactant, an anionic surfactant, a cationic surfactant or an amphoteric surfactant, with a nonionic surfactant and an anionic surfactant being particularly preferably used in the present invention. These surfactants serve as emulsifying agents for diluting the metal working fluid composition of the present invention with water. Moreover, the isothiazoline compound is hardly soluble in water and therefore, the surfactant may likewise serve as a dispersion-stabilizer for maintaining the dispersion stability of the isothiazoline compound when diluting the fluid composition with water and practically using the same.

Examples of such nonionic surfactants usable herein are polyoxyethylene alkyl ether types, polyoxyethylene alkyl phenyl ether types, polyoxyethylene fatty acid ester types, polyoxyethylene castor oil types, polyoxyethylene fatty acid diester types, polyoxyethylene rosin ester types, polyoxyethylene lanolin ether types, polyoxyethylene polyhydric alcohol ether types, polyoxyethylene polyhydric alcohol fatty acid ester types, polyhydric alcohol fatty acid ester types, ethylene oxide-propylene oxide block polymer types, ethylene oxide-propylene oxide random polymer types, propylene oxide polymer types, and polyhydric alcohol-alkylene oxide polymer types.

Examples of such anionic surfactants usable herein are fatty acid derivatives (such as fatty acid soap, naphthenic acid soap and fatty acid amides), sulfuric acid ester type compounds (such as alcohol sulfuric acid ester salts, olefin sulfuric acid ester salts, polyoxyethylene alkyl ether sulfuric acid ester salts, and fatty acid polyhydric alcohol sulfuric acid ester salts), sulfonic acid type compounds (such as alkane sulfonic acid salts, petroleum sulfonic acid salts, α-olefin sulfonic acid salts, alkyl-naphthalene sulfonic acid salts, and phosphoric acid ester types (such as alkyl phosphoric acid ester salts and polyoxyethylene alkyl-phenol ether phosphoric acid ester salts). In this respect, the foregoing nonionic and anionic surfactants may be used in combination. Furthermore, also usable herein include known cationic surfactants and amphoteric surfactants.

The rate (by mass) of the morpholine compound present in the metal working fluid composition of the present invention preferably ranges from 0.01 to 10.0% by mass and more preferably 0.05 to 5.0% by mass on the basis of the total mass of the fluid composition (the stock liquid prior to the dilution thereof with water; those in the following description are shown in the same way also, unless otherwise specified). If the content of this component is less than the lower limit, there is observed such a tendency that the desired antiseptic effect can be accomplished only with great difficulty, while even if the content of this component exceeds the upper limit, any intended effect in proportion to the added amount thereof cannot be expected in some cases.

The rate (by mass) of the isothiazoline compound present in the metal working fluid composition of the present invention preferably ranges from 0.001 to 5.0% by mass and more preferably 0.005 to 3.0% by mass on the basis of the total mass of the fluid composition. This is because if the content of this component is less than the lower limit, there is observed such a tendency that the desired antiseptic effect can be accomplished only with great difficulty, while even if the content of this component exceeds the upper limit, any intended effect in proportion to the added amount thereof cannot be expected in some cases.

The rate (by mass) of the surfactant present in the metal working fluid composition of the present invention preferably ranges from 0.1 to 80.0% by mass and more preferably 0.2 to 50.0% by mass on the basis of the total mass of the fluid composition. In this respect, if the amount of the surfactant is less than the lower limit specified above, there is observed a tendency such that it is difficult to dilute the resulting fluid composition with water, that it would also be difficult to stably disperse the isothiazoline compound in the diluted fluid composition and that the desired antiseptic properties can thus be imparted to the resulting fluid composition only with great difficulty.

The metal working fluid composition of the present invention comprises a base oil as the need arises. Examples of such base oils include mineral oils, polyol esters, fats and oils, polyglycols, poly(α-olefins), normal paraffins, iso-paraffins, alkyl-benzenes, and polyethers. These base oils may be used alone or as a blend oil comprising a plurality of these base oils. Preferably used herein include mineral oils, polyglycols and alkyl-benzenes.

Further, the metal working fluid composition of the present invention may likewise comprise, as the occasion may demand, an anti-foaming agent and other additives (such as an extreme pressure additive, an anticorrosive agent, a viscosity index improver, an antioxidant, a detergent-dispersant, a coloring agent and an aromatic).

The metal working fluid composition of the present invention may be any one of emulsion type, soluble type and solution types and it is in general used after it is diluted with water to give a dilute liquid having a concentration ranging from about 1 to 30% by mass.

EXAMPLES

Each of the metal working fluid compositions specified in the following Tables 1 to 4 were evaluated and inspected for antiseptic properties according to the antiseptic test detailed below.

The fluid compositions listed in Tables 1 and 3 are water-soluble metal working fluid compositions, each of which is prepared using a mineral oil or a synthetic base oil (an alkyl-benzene), while the fluid compositions shown in Tables 2 and 4 are water-soluble metal working fluid compositions, each of which is prepared using a naturally occurring base oil (such as rapeseed oil).

Test for Evaluating Antiseptic Properties

Each fluid composition was diluted with sterilized water to give a diluted fluid composition having a concentration of 2% by mass, then 10 mL of a putrefactive bacteria-containing liquid (*1) as specified below was added to 100 mL of the diluted composition, the resulting mixture was subjected to shaking culture at 30° C. for 2 weeks and then the number of viable bacterial bodies (viable count) was determined.

(*1): Putrefactive Bacteria-Containing Liquid:

| | Amt. (% by mass) |
|---|---|
| Emulsion type cutting fluid composition putrefied and deteriorated | 10.0 |
| Trypto-soy bouillon culture medium | 1.0 |
| Glucose-peptone culture medium | 1.0 |
| Sterilized water | 88.0 |

The putrefactive liquid used herein was a putrefactive bacteria-containing liquid prepared by cultivating the foregoing mixture at 25° C. for 24 hours wherein the number of viable bacterial bodies was adjusted to the level of not less than $10^7$.

Evaluation Criteria:

The bacterial counts, the numbers of mold, yeast and anaerobic bacterial cells or the pollution level were evaluated using SAN-AI Biochecker (available from SAN-AI Petroleum Co., Ltd.).

Regarding the bacterial counts and the number of yeast cells, the number of microorganisms present in 1 mL of each sample was evaluated according to the following 8-stage criteria: 0, $10^3$ cells>, $10^3$ cells, $10^4$ cells, $10^5$ cells, $10^6$ cells, $10^7$ cells, $10^7$ cells<, and a sample containing bacterial cells of less than $10^3$ cells was judged to be acceptable (○).

On the other hand, regarding the numbers of mold and anaerobic bacterial cells, the pollution level was evaluated according to the following 4-stage criteria: zero, slight (low degree), medium (medium degree) and heavy (high degree), and a sample having a pollution level of zero was defined to be acceptable (○).

Test for Confirming the Stability of Diluted Liquid:

Using prepared hard water (water prepared by diluting 0.0757 g of calcium chloride.$2H_2O$ with distilled water to give one liter of an aqueous solution thereof; having a German hardness of 3 degrees; a Ca hardness of 54 ppm, see JIS K 2221 "Cutting Fluid Composition: Test Thereof for Emulsion Stability"), each fluid composition is diluted with water to give a dilute liquid having a concentration of 5%, the conditions thereof immediately after the preparation and after the elapse of 24 hours from the preparation are visually observed. The evaluation criteria used herein are as follows:

○: Acceptable: The sample is uniformly dissolved in water and does not cause any separation and is free of the formation of any cream layer;

x: Unacceptable: The sample undergoes phase separation and forms a cream layer.

Tables 1 to 4 show the compositions or formulations used in Examples and Comparative Examples and the results obtained in the foregoing evaluation tests. As will be seen from the results listed in Tables 1 to 4, the water-soluble metal working fluid compositions of the present invention prepared in Examples 1 to 11, each of which comprises the component (A) and the component (B) are found to be excellent in the antiseptic properties. Therefore, the water-soluble metal working fluid composition of the present invention can stably be used as the metal working lubricating agent upon processing of a variety of metals over a long period of time.

Contrary to this, the water-soluble metal working fluid compositions prepared in Comparative Examples 1 to 12, each of which is free of at least one of the component (A) and the component (B) are found to be insufficient in antiseptic properties.

TABLE 1

| Compositional Rate (%) | Example No. 1 | 2 | 3 | 4 | 5 | 6 |
|---|---|---|---|---|---|---|
| Component (A): N,N-methylene-bis-morpholine | 1.0 | 1.0 | 10.0 | 1.0 | 0.5 | 1.0 |
| Component (B): N-n-Butyl-1,2-benzoisothiazolin-3-one | 0.1 | 0.1 | 1.0 | 5.0 | 0.1 | 0.05 |
| Component (C) | | | | | | |
| Na Petroleum sulfonate | 10.0 | 10.0 | 10.0 | 10.0 | 10.0 | 10.0 |
| Castor oil-fatty acid condensate (acid value: 32) | 5.0 | 5.0 | 5.0 | 5.0 | 5.0 | 5.0 |
| Oleic acid triethanol-amine salt | 10.0 | 10.0 | 10.0 | 10.0 | 10.0 | 10.0 |
| Base Oil: | | | | | | |
| Mineral oil | 68.9 | | 59.0 | 64.0 | | 68.95 |
| Alkyl-benzene | | 68.9 | | | 69.4 | |
| Antiseptic agent: Triazine | | | | | | |
| Water | 5.0 | 5.0 | 5.0 | 5.0 | 5.0 | 5.0 |
| Total Amount | 100.0 | 100.0 | 100.0 | 100.0 | 100.0 | 100.0 |
| Antiseptic Properties | | | | | | |
| Bacterial count | zero | zero | zero | zero | zero | zero |
| Mold | zero | zero | zero | zero | zero | zero |
| Yeast | zero | zero | zero | zero | zero | zero |
| Anaerobic bacteria | zero | zero | zero | zero | zero | zero |
| Overall Evaluation | | | | | | |
| Antiseptic properties | ○ | ○ | ○ | ○ | ○ | ○ |
| Stability of diluted liquid | ○ | ○ | ○ | ○ | ○ | ○ |

TABLE 2

| Compositional Rate (%) | Example No. 7 | 8 | 9 | 10 | 11 |
|---|---|---|---|---|---|
| Component (A): N,N-methylene-bis-morpholine | 3.0 | 10.0 | 1.0 | 0.5 | 1.0 |
| Component (B): N-n-Butyl-1,2-benzo-isothiazolin-3-one | 0.3 | 1.0 | 5.0 | 0.1 | 0.05 |
| Component (C) | | | | | |
| Polyoxyethylene oleyl ether | 25.0 | 25.0 | 25.0 | 25.0 | 25.0 |
| Castor oil-fatty acid condensate (acid value: 32) | 11.0 | 11.0 | 11.0 | 11.0 | 11.0 |
| Base Oil: Rapeseed oil | 49.7 | 42.0 | 47.0 | 52.4 | 51.95 |
| Antiseptic Agent: Triazine | | | | | |
| Stabilizer: n-octadecenyl alcohol | 11.0 | 11.0 | 11.0 | 11.0 | 11.0 |
| Total Amount | 100.0 | 100.0 | 100.0 | 100.0 | 100.0 |
| Antiseptic Properties | | | | | |
| Bacterial count | zero | zero | zero | zero | zero |
| Mold | zero | zero | zero | zero | $10^3$> |
| Yeast | zero | zero | zero | zero | zero |
| Anaerobic bacteria | zero | zero | zero | zero | zero |
| Overall Evaluation | | | | | |
| Antiseptic properties | ○ | ○ | ○ | ○ | ○ |
| Stability of diluted liquid | ○ | ○ | ○ | ○ | ○ |

TABLE 3

| Compositional Rate (%) | | Comparative Example No. 1 | 2 | 3 | 4 | 5 | 6 |
|---|---|---|---|---|---|---|---|
| Component (A): N,N-methylene-bis-morpholine | | | 1.0 | | | | |
| Component (B): N-n-Butyl-1,2-benzoisothiazolin-3-one | | 0.1 | | | 0.1 | 0.1 | 0.1 |
| Component (C) | | | | | | | |
| Na petroleum sulfonate | | 10.0 | 10.0 | 10.0 | 10.0 | 10.0 | 10.0 |
| Castor oil-fatty acid condensate (acid value: 32) | | 5.0 | 5.0 | 5.0 | 5.0 | 5.0 | 5.0 |
| Oleic acid triethanol-amine salt | | 10.0 | 10.0 | 10.0 | 10.0 | 10.0 | 10.0 |
| Base Oil | Mineral oil | 69.9 | 69.0 | 73.9 | 68.9 | 66.9 | 66.9 |
| | Alkyl-benzene | | | | | | |
| Antiseptic Agent | | | | | | | |
| Triazine | | | | 1.1 | 1.0 | | |
| 2-[hydroxy(methyl)amino] ethanol | | | | | | 3.0 | |
| Hexahydro-1,3,5-tris(2-hydroxyethyl)-1,3,5-triazine | | | | | | | 3.0 |
| Water | | 5.0 | 5.0 | 5.0 | 5.0 | 5.0 | 5.0 |
| Total Amount | | 100.0 | 100.0 | 100.0 | 100.0 | 100.0 | 100.0 |
| Antiseptic Properties | Bacterial count | $10^6$ | $10^6$ | $10^6$ | $10^5$ | $10^5$ | $10^5$ |
| | Mold | zero | zero | zero | zero | zero | zero |
| | Yeast | $10^5$ | $10^5$ | $10^5$ | $10^5$ | $10^5$ | $10^5$ |
| | Anaerobic bacteria | slight | slight | slight | slight | slight | slight |
| Overall Evaluation | | | | | | | |
| Antiseptic properties | | X | X | X | X | X | X |
| Stability of diluted liquid | | ○ | ○ | ○ | ○ | ○ | ○ |

TABLE 4

| Compositional Rate (%) | Comparative Example No. 7 | 8 | 9 | 10 | 11 | 12 |
|---|---|---|---|---|---|---|
| Component (A): N,N-methylene-bis-morpholine | | 3.0 | | | | |
| Component (B): N-n-Butyl-1,2-benzoisothiazolin-3-one | 0.3 | | | 0.3 | 0.3 | 0.3 |
| Component (C) | | | | | | |
| Polyoxyethylene oleyl ether | 25.0 | 25.0 | 25.0 | 25.0 | 25.0 | 25.0 |
| Castor oil-fatty acid condensate (acid value: 32) | 11.0 | 11.0 | 11.0 | 11.0 | 11.0 | 11.0 |
| Base Oil: Rapeseed oil | 52.7 | 50.0 | 49.7 | 49.7 | 49.7 | 49.7 |
| Antiseptic Agent | | | | | | |
| Triazine | | | 3.3 | 3.0 | | |
| 2-[hydroxy(methyl)amino] ethanol | | | | | 3.0 | |
| Hexahydro-1,3,5-tris(2-hydroxyethyl)-1,3,5-triazine | | | | | | 3.0 |
| Stabilizer: n-octadecenyl alcohol | 11.0 | 11.0 | 11.0 | 11.0 | 11.0 | 11.0 |
| Total Amount | 100.0 | 100.0 | 100.0 | 100.0 | 100.0 | 100.0 |
| Antiseptic Properties: Bacterial count | $10^6$ | $10^7$ | $10^7$< | $10^7$ | $10^7$ | $10^7$ |
| Mold | zero | zero | zero | zero | zero | zero |
| Yeast | $10^5$ | $10^5$ | $10^6$ | $10^5$ | $10^6$ | $10^5$ |
| Anaerobic bacteria | slight | slight | heavy | slight | slight | slight |
| Overall Evaluation | | | | | | |
| Antiseptic properties | X | X | X | X | X | X |
| Stability of diluted liquid | ○ | ○ | ○ | ○ | ○ | ○ |

What is claimed is:

1. A metal working fluid composition which comprises a morpholine compound and an isothiazoline compound, wherein the morpholine compound is N,N-methylene-bis-morpholine and the isothiazoline compound is N-n-butyl-1,2-benzo-isothiazolin-3-one.

2. The metal working fluid composition as set forth in claim 1, which further comprises a surfactant.

3. The metal working fluid composition as set forth in claim 2, wherein the surfactant is at least one member selected from the group consisting of nonionic surfactants, anionic surfactants, cationic surfactants, and amphoteric surfactants.

4. The metal working fluid composition as set forth in claim 1, wherein the fluid composition comprises 0.01 to 10.0% by mass of the morpholine compound, and 0.001 to 5.0% by mass of the isothiazoline compound.

5. The metal working fluid composition as set forth in claim 2, wherein the fluid composition comprises 0.05 to 80% by mass of the surfactant.

6. A metal working method characterized in that a metal working fluid composition as set forth in claim 1 is diluted with water to give a liquid having a concentration ranging from 1 to 30% by mass prior to the practical use thereof.

7. The metal working method as set forth in claim 6, wherein the metal working is cutting process or grinding process.

* * * * *

UNITED STATES PATENT AND TRADEMARK OFFICE

CERTIFICATE OF CORRECTION

PATENT NO. : 8,375,755 B2
APPLICATION NO. : 12/525145
DATED : February 19, 2013
INVENTOR(S) : Goto et al.

It is certified that error appears in the above-identified patent and that said Letters Patent is hereby corrected as shown below:

Title Page, Item (87) should read as follows:

(87) PCT Pub. No.: WO2008/093844
--PCT Pub. Date: August 7, 2008--

Signed and Sealed this
Seventeenth Day of September, 2013

Teresa Stanek Rea
*Deputy Director of the United States Patent and Trademark Office*